US009733622B2

(12) United States Patent
Knuchel

(10) Patent No.: US 9,733,622 B2
(45) Date of Patent: Aug. 15, 2017

(54) BRAZED BIMETAL EXTERNAL PART OF A TIMEPIECE

(71) Applicant: The Swatch Group Research and Development Ltd, Marin (CH)

(72) Inventor: Daniel Knuchel, Biel (CH)

(73) Assignee: The Swatch Group Research and Development Ltd, Marin (CH)

( * ) Notice: Subject to any disclaimer, the term of this patent is extended or adjusted under 35 U.S.C. 154(b) by 305 days.

(21) Appl. No.: 14/401,730

(22) PCT Filed: May 17, 2013

(86) PCT No.: PCT/EP2013/060262
§ 371 (c)(1),
(2) Date: Nov. 17, 2014

(87) PCT Pub. No.: WO2013/174749
PCT Pub. Date: Nov. 28, 2013

(65) Prior Publication Data

US 2015/0124573 A1 May 7, 2015

(30) Foreign Application Priority Data

May 22, 2012 (EP) ..... 12168905

(51) Int. Cl.
*A44C 5/00* (2006.01)
*G04B 37/22* (2006.01)
*G04D 3/00* (2006.01)

(52) U.S. Cl.
CPC ..... *G04B 37/22* (2013.01); *A44C 5/00* (2013.01); *G04B 37/221* (2013.01);
(Continued)

(58) Field of Classification Search
CPC ..... Y10T 29/49579; Y10T 29/49584; Y10T 29/49588; Y10T 29/49597;
(Continued)

(56) References Cited

U.S. PATENT DOCUMENTS 1,634,562 A * 7/1927 Shapiro ..... B21D 5/16 29/896.411
1,678,239 A * 7/1928 Bayardi ..... B21D 53/44 29/896.41
(Continued)

FOREIGN PATENT DOCUMENTS

CH 517 963 1/1965
EP 1 439 434 7/2004
(Continued)

OTHER PUBLICATIONS

International Search Report Issued Mar. 6, 2014 in PCT/EP13/060262 Filed May 17, 2013.

*Primary Examiner* — Jason L Vaughan
(74) *Attorney, Agent, or Firm* — Oblon, McClelland, Maier & Neustadt, L.L.P.

(57) ABSTRACT

A method of manufacturing an external part of a timepiece, including: providing a metallic base made of a first material including titanium and/or a first titanium alloy; providing at least one metallic cover plate made of a second material, the second material including a second metal chosen from among gold or platinum, and/or a second alloy including at least gold or platinum, the at least one cover plate being of a thickness greater than or equal to 0.5 millimeters; brazing the cover plate onto the base with a braze material chosen for brazing titanium with gold or respectively platinum to form a bimetallic blank; and shaping the bimetallic blank to give the external part its final form.

12 Claims, 3 Drawing Sheets

(52) U.S. Cl.
CPC ..... *G04D 3/0097* (2013.01); *Y10T 29/49584* (2015.01); *Y10T 29/49588* (2015.01)

(58) Field of Classification Search
CPC ..... Y10T 29/49595; Y10T 29/49591; Y10T 29/49583; G04B 37/00; G04B 37/0008; G04B 37/22; G04B 37/221
See application file for complete search history.

(56) References Cited

U.S. PATENT DOCUMENTS 2,948,041 A * 8/1960 Evans ..... A44C 7/006 228/224
2,976,607 A * 3/1961 Obst ..... A44C 5/02 29/896.411
3,046,726 A * 7/1962 Gay ..... A44C 5/107 29/896.41
3,109,229 A * 11/1963 Cataldi ..... A44B 5/00 24/97
3,254,396 A * 6/1966 Mushey ..... A44C 5/025 29/413
4,403,014 A * 9/1983 Bergmann ..... A44C 27/006 428/546
4,495,254 A * 1/1985 Hoffman ..... A44C 27/005 368/280
4,533,605 A * 8/1985 Hoffman ..... A44C 27/005 368/280
4,557,981 A * 12/1985 Bergmann ..... C23C 14/165 428/610
4,640,869 A * 2/1987 Loth ..... C23C 14/0015 428/469
4,699,850 A * 10/1987 Kishi ..... C23C 28/00 428/469
4,725,511 A * 2/1988 Reber ..... A44C 27/00 29/896.32
4,737,252 A * 4/1988 Hoffman ..... A44C 27/005 204/192.16
4,745,035 A * 5/1988 Saurer ..... A44C 27/006 428/614
4,942,755 A * 7/1990 Gogniat ..... G04B 37/0058 29/896.33
5,077,710 A * 12/1991 Gogniat ..... G04B 37/0058 29/896.33
5,985,469 A * 11/1999 Kurakata ..... A44C 27/006 204/298.13
9,066,564 B2 * 6/2015 Tsukamoto ..... A44C 27/006
9,469,765 B2 * 10/2016 Takazaki ..... C23C 14/0015
2003/0170487 A1 * 9/2003 Miyama ..... B32B 15/012 428/660
2004/0233795 A1 11/2004 Fujii et al.
2004/0257915 A1 * 12/2004 Miyama ..... G04B 37/22 368/280
2011/0041553 A1 * 2/2011 Xiong ..... B23K 1/0008 63/1.12

FOREIGN PATENT DOCUMENTS

JP 56 105881 8/1981
JP 57 67876 4/1982
JP 57 72848 5/1982
JP 60-22866 A * 11/1985
JP 60 228666 11/1985

* cited by examiner

BRAZED BIMETAL EXTERNAL PART OF A TIMEPIECE

CROSS-REFERENCE TO RELATED APPLICATIONS

This is a National Phase Application in the United States of International Patent Application PCT/EP2013/060262 filed May 17, 2013 which claims priority on European Patent application No. 12168905.3 filed May 22, 2012. The entire disclosures of the above patent applications are hereby incorporated by reference.

FIELD OF THE INVENTION

The invention concerns a method of manufacturing an external part of a timepiece.

The invention also concerns an external part of a timepiece.

The invention also concerns a timepiece, particularly a watch, including at least one such external part.

BACKGROUND OF THE INVENTION

The manufacture of external parts of a timepiece is often accomplished using noble metals, such as gold or platinum, so as to ensure excellent resistance to corrosion. However, these metals are of high density, and the timepieces thereby made, particularly watches, are very heavy for the user, and are also expensive. A material such as gold is malleable, and its mechanical qualities are average, which often means that it is necessary to select gold alloys, which are more resistant, but also more susceptible to corrosion, with variations in appearance over time.

JP Patent Application No 60228666A in the name of CITIZEN describes the brazing of gold or gold alloy components on a titanium or titanium alloy base, and uses a TiN surface obtained by nitriding to stop the gold penetrating the titanium.

JP Patent Application No 56105881A in the name of SEIKO describes the brazing of gold or gold alloy components on a copper alloy base.

EP Patent Application No 1439434A1 in the name of CITIZEN discloses the brazing of components on a titanium base.

SUMMARY OF THE INVENTION

The invention proposes to offer an alternative to the utilisation of external parts of a timepiece made entirely of noble metals.

To this end, the invention concerns a method of manufacturing an external part of a timepiece or of a piece of jewellery, characterized in that:

- a metallic base is provided made of a first material, said first material includes a transition metal or titanium and/or a first alloy of said transition metal or of titanium,
- at least one metallic cover plate is provided made of a second material, said second material includes a second metal chosen from among gold, platinum, palladium or silver, and/or a second alloy including at least gold or platinum or palladium or silver, said at least one cover plate being of a thickness greater than or equal to 0.5 millimeters;
- said at least one cover plate is brazed onto said base so as to form a bimetal blank;
- said bimetal blank is shaped to give said structural component its final shape.

According to a particular characteristic of the invention, said brazing operation is performed with a braze material selected to form a braze, between, on the one hand, said first material, and on the other hand, said second material.

The invention also concerns an external part of a timepiece, characterized in that the part is made of bimetallic material including a metallic base made of a first material, said first material includes titanium or a transition metal except nickel, and/or includes a first alloy of said transition metal or of titanium, and at least one metallic cover plate made of a second material, said second material includes a second metal chosen from among gold, platinum, palladium or silver, and/or includes a second alloy including at least gold or platinum or palladium or silver, and in that said base and said cover plate are brazed to one another, and in that said at least one cover plate has a thickness greater than or equal to 0.5 millimeters.

The invention also concerns a timepiece, particularly a watch, including at least one such external part.

The invention also concerns piece of jewellery, characterized in that the piece is made of bimetallic material including a metallic base made of a first material, said first material includes titanium or a transition metal except nickel, and/or includes a first alloy of said transition metal or of titanium, and at least one metallic cover plate made of a second material, said second material includes a second metal chosen from among gold, platinum, palladium or silver, and/or includes a second alloy including at least gold or platinum or palladium or silver, and in that said base and said cover plate are brazed to one another, and in that said at least one cover plate has a thickness greater than or equal to 0.5 millimeters.

BRIEF DESCRIPTION OF THE DRAWINGS

Other features and advantages of the invention will appear upon reading the following detailed description, with reference to the annexed drawings, in which:

FIG. 14 shows a perspective view of the preparation of a titanium base, with cutouts and through apertures; FIG. 15 shows the pre-folding of the base to transform into stirrups the cross-pieces formed by cutting in the first operation, FIG. 16 shows the bimetallic blank after brazing gold cover plates onto some surfaces of the base, FIG. 17 shows a schematic, end view of a section obtained by sawing the blank, which is then shaped by deformation to form the external part shown in FIG. 18, in this case a claw.

DETAILED DESCRIPTION OF PREFERRED EMBODIMENTS

Figure 1:
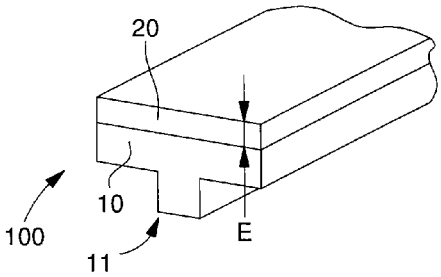
FIG. 1 shows a schematic, perspective view of an external part according to the invention, with a cover plate brazed onto a profiled base.

The invention proposes to offer an alternative to the utilisation of external parts of a timepiece made entirely of noble metals, particular of a gold or platinum alloy, which are very heavy for the user and expensive.

In particular, in the case of watch parts, which are the preferred application of the invention, although the invention is directly applicable to jewellery parts, the external parts must exhibit excellent resistance to corrosion, yet still have good mechanical qualities.

The invention proposes to combine, within the same external part, the advantages of high mechanical resistance of a first constituent, hereafter termed the "base", made of a material selected both for its mechanical resistance and its resistance to corrosion, and the advantages of appearance and high resistance to corrosion of at least a second constituent, hereafter termed the "cover plate". The invention concerns solid parts, wherein the thickness E of each constituent is preferably greater than 0.5 millimeters.

Indeed, as will be seen later in the description, the invention incorporates a brazing operation. This operation is all the more easy to control if the parts to be brazed to each other are thick and of comparable thickness. Naturally, the invention may also be implemented with constituents of smaller thickness, for example greater than 0.2 millimeters.

To this end, the invention concerns a method of manufacturing an external part 100 of a timepiece or of a piece of jewellery 200.

According to this method:

- a metallic base 10 is provided made of a first material, said first material includes a transition metal or titanium and/or a first alloy of said transition metal or of titanium,
- at least one metallic cover plate 20 is provided made of a second material, said second material includes a second metal chosen from among gold, platinum, palladium or silver, and/or a second alloy including at least gold or platinum or palladium or silver, said at least one cover plate 20 being of a thickness E greater than or equal to 0.5 millimeters;
- said at least one cover plate 20 is brazed onto said base 10 so as to form a bimetallic blank 30;
- the bimetallic blank 30 is shaped, by roll bonding or co-drawing, or suchlike and/or machined to give the structural part 100, or the piece of jewellery 200, as appropriate, its final form.

In a particular implementation of the method, said brazing operation is performed with a braze material 40 selected to form a braze, between, on the one hand, said first material, and on the other hand, said second material.

Advantageously, when the second material contains gold, braze material 40 is composed by choosing one braze material or by combining several braze materials from among the following:

- Ag—Cu braze;
- Ag—Cu—X braze, the component X being chosen from among Zn and Sn;
- "CF72Ti" Ag—Cu—Ti produced by HILDERBRAND & CIE SA of 1226 Thônex, Switzerland;
- "CFPDAG" Pd—Ag—Ga produced by HILDERBRAND & CIE SA of 1226 Thônex, Switzerland;
- "CF PDXT2" Pd300-Ag500-Cu200 produced by HILDERBRAND & CIE SA of 1226 Thônex, Switzerland;
- "CF 18KWH2" Au750-Pd125-Ag20, nickel-free, produced by HILDERBRAND & CIE SA of 1226 Thônex, Switzerland;

Preferably, the first alloy and second alloy will be chosen to be hypo-allergenic, and particularly with zero nickel content.

In a specific variant, the first material is chosen to include a transition metal from among chromium, cobalt or molybdenum.

As regards base 10, grade 2 titanium, or grade 5 titanium or T35 titanium is advantageously chosen as the first material of base 10. Grade 2 titanium is particularly suited for a high quality braze with an 18 carat gold alloy. Titanium and its alloys form a family having similar mechanical qualities to those of steels, for a much smaller mass than that of steels, in addition to a very high resistance to corrosion, particularly to saline mist.

Preferably, an 18 carat gold alloy or a platinum alloy with at least 95% platinum is preferably chosen for the second material.

When a gold alloy is used, a 5N or 3N 18 carat gold alloy is advantageously chosen for this second material.

Figure 2:
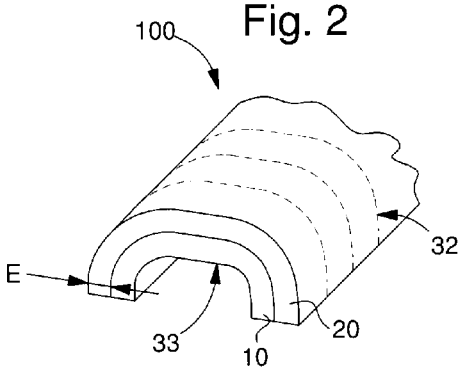
FIG. 2 shows a schematic, perspective view of an external part according to the invention, with a cover plate brazed onto a base and stamped therewith after brazing.
Figure 10:
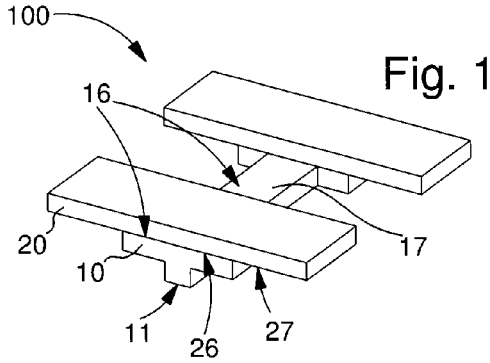
FIG. 10 shows a schematic, perspective view of an external part according to the invention, with two cover plates brazed onto the same profiled base on only one portion of the lower surface of the cover plate facing said base.
Figure 11:
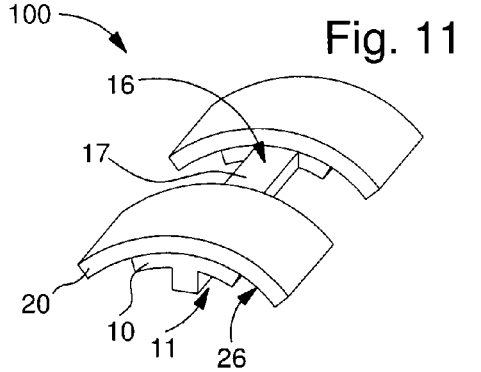
FIG. 11 shows a schematic, perspective view of an external part according to the invention, similar to FIG. 10, and wherein four lateral wings are formed by drawing after brazing.

In some variant embodiments, as seen, for example, in FIG. 2, this bimetallic blank 30 is shaped by stamping and/or drawing deformation. In other variants, as illustrated in FIG. 10 or 11, the bimetallic blank 30 is machined to remove cover plate 20 locally, so as to reveal locally at least one surface 16 of base 10.

In an advantageous embodiment for securing part 100 to a watch or the like, base 10 is advantageously chosen in the form of a profile bar 11.

Figure 3:
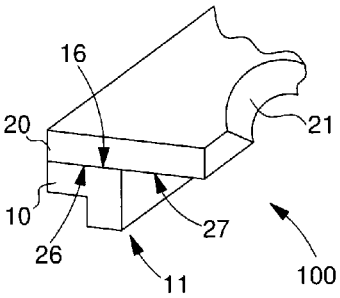
FIG. 3 shows a schematic, perspective view of an external part according to the invention, with a cover plate which includes a cutout and is brazed onto a profiled base on only one portion of the lower surface of the cover plate facing said base.
Figure 4:
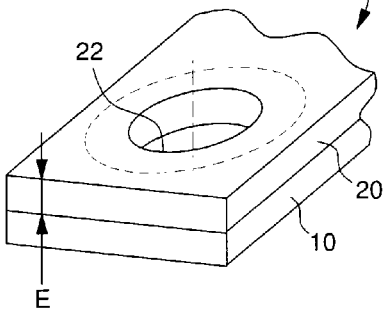
FIG. 4 shows a schematic, perspective view of a bimetallic blank according to the invention, with a cover plate which includes a through aperture and is brazed onto a base.

In some applications, as seen in FIG. 3 or 4, cover plate 20 is chosen to be pre-machined with at least one cutout 21 and/or through aperture 22.

Figure 6:
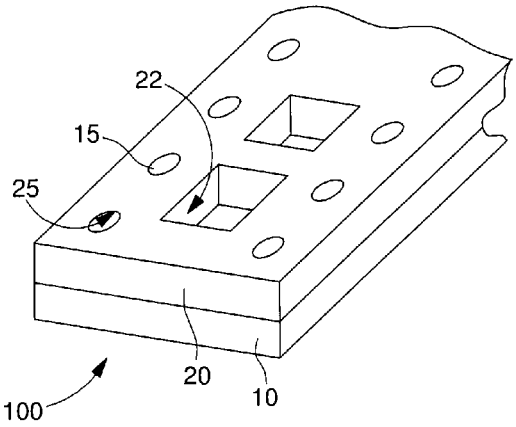
FIG. 6 shows a schematic, perspective view of an external part according to the invention, with a cover plate including positioning bores and through apertures, brazed onto a base including positioning pins corresponding to the bores in the plate.
Figure 5:
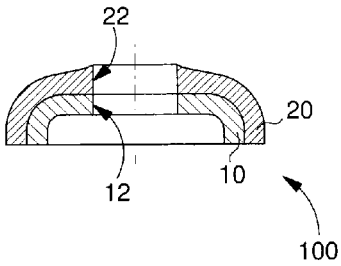
FIG. 5 shows a transverse cross-section of an external part obtained by finishing the bimetallic blank of FIG. 4, with the external profile formed by drawing and/or machining, and an aperture, machined after brazing, so as to form, for example, a watch bezel.
Figure 7:
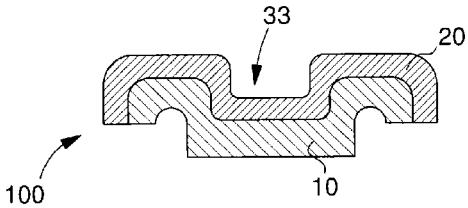
FIG. 7 shows a schematic, transverse cross-sectional view of an external part similar to that of FIG. 2, with a deep stamped section made after brazing.
Figure 8:
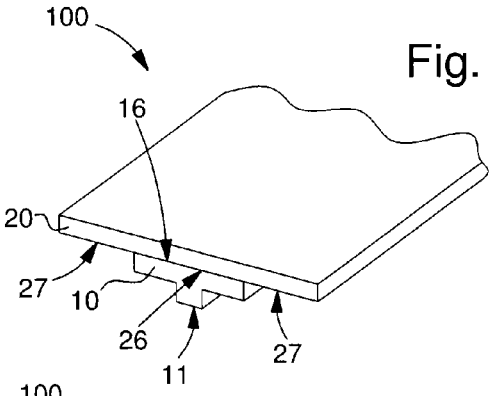
FIG. 8 shows a schematic, perspective view of an external part according to the invention, with a cover plate brazed onto a profiled base on only one portion of the lower surface of the cover plate facing said base.
Figure 9:
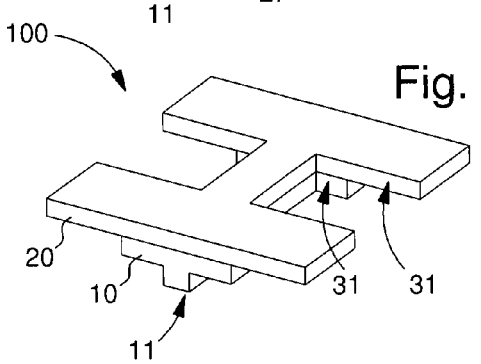
FIG. 9 shows a schematic, perspective view of an external part according to the invention, similar to that of FIG. 8 and including H-shaped machined cutouts formed in the assembly after brazing.

For optimum relative positioning, before being brazed to each other, base 10 and cover plate 20 are advantageously prepared with raised and/or hollowed markings 15, 25, as seen in FIG. 6, to geometrically match said base and plate prior to the brazing operation and to hold them in relation to each other during the brazing operation.

In a variant, as seen in FIG. 1, 2, 4, 6 or 10, cover plate 20 is pressed onto base 10 over their entire mutual contact surface.

The example of FIGS. 4 and 6 shows, in a simplified manner, the making of a watch bezel, with prior preparation of a bimetallic blank 30 from a cover plate 20 which includes a through aperture 22 and is brazed onto a base 10. This blank 30 is then shaped by deformation and/or machining, with the external profile formed by drawing and/or machining, and an aperture 12 machined, after brazing, in base 10 in the extension of aperture 22, or by re-machining aperture 22 both in base 10 and in cover plate 20.

In other variants, cover plate 20 is brazed onto base 10 on only one portion of the surface 26 of cover plate 20 facing said base 10, and/or on only one portion of surface 16 of base 10 facing said cover plate 20.

Figure 12:
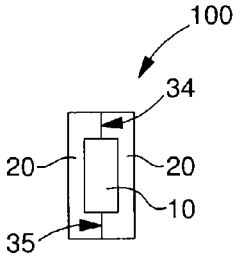
FIG. 12 shows a schematic, transverse cross-sectional view of an external part according to the invention, including two cover plates made of a gold or platinum alloy and brazed on both sides of a titanium or titanium alloy base.
Figure 13:
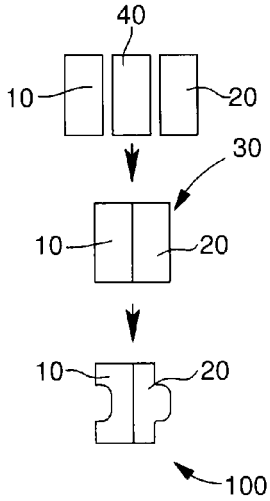
FIG. 13 shows a block diagram of the method of manufacturing a part according to the invention.

Naturally, it is understood that the notion of "bimetallic" is not restrictive, since base 10 can itself be made according to the invention, and include pairs of brazed layers: the invention also applies to a sandwich type external part 100, including two cover plates 20 made of a gold or platinum alloy band brazed on either side of a base 10 made of titanium or a titanium alloy. This configuration may be required by constraints of external appearance. The titanium core guarantees rigidity and perfect positioning relative to the other parts of the timepiece. As seen in FIG. 12, cover plates 20 may be contiguous with each other on a junction surface 34, or on a junction plane if they are flat, and be brazed or soldered gold-on-gold on the seam 35. The invention may, therefore, extend to the manufacture of voluminous parts, made by brazing pairs of opposing surfaces, one made of titanium or titanium alloy, and the other of gold or a gold alloy or a titanium alloy.

The invention also concerns an external part 100 of a timepiece, which is made of bimetallic material including a metallic base 10 made of a first material, said first material includes titanium or a transition metal except nickel, and/or includes a first alloy of titanium or of said transition metal, and at least one metallic cover plate 20 made of a second material. This second material includes a second metal chosen from among gold, platinum, palladium or silver, and/or includes a second alloy including at least gold or platinum or palladium or silver. Base 10 and cover plate 20 are assembled to one another by a brazed connection, and this at least one cover plate 20 has a thickness E greater than or equal to 0.5 millimeters.

More specifically, this bimetallic material external part 100 of a timepiece includes a metallic base 10 made of a first material including titanium and/or a first titanium alloy, and at least one metallic cover plate 20 made of a second material including a second metal chosen from among gold and platinum and/or a second alloy including at least gold or platinum, and said base 10 and said cover plate 20 are brazed to each other, and cover plate 20 has a thickness E greater than or equal to 0.5 millimeters.

The invention also concerns a timepiece, particularly a watch 1000, including at least one such external part 100.

The invention also concerns a piece of jewellery 200, which is made of bimetallic material including a metallic base 10 made of a first material, said first material includes titanium or a transition metal except nickel, and/or includes a first alloy of titanium or of said transition metal, and at least one metallic cover plate 20 made of a second material. This second material includes a second metal chosen from among gold, platinum, palladium or silver, and/or includes a second alloy including at least gold or platinum or palladium or silver. Base 10 and cover plate 20 are assembled to one another by a brazed connection, and this at least one cover plate 20 has a thickness E greater than or equal to 0.5 millimeters. FIGS. 14 to 18 illustrate a non-limiting example of the manufacture of claws 100 for a watch 1000.

Figure 14:
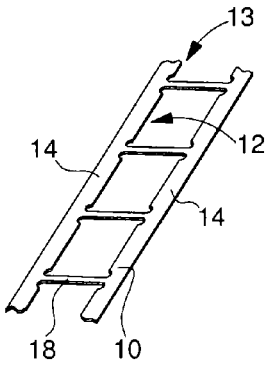
FIGS. 14 to 18 illustrate the manufacture of claws for a watch.
Figure 15:
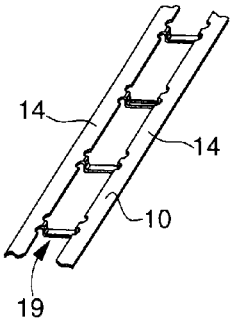
Figure 16:
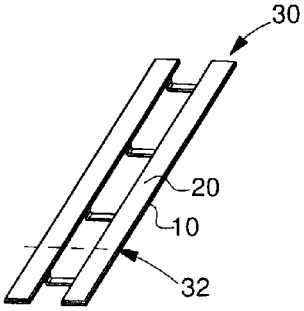
Figure 17:
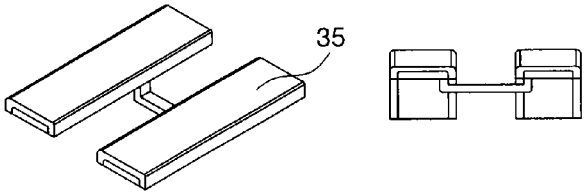
Figure 18:
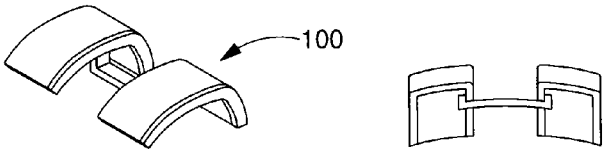
Figure 19:
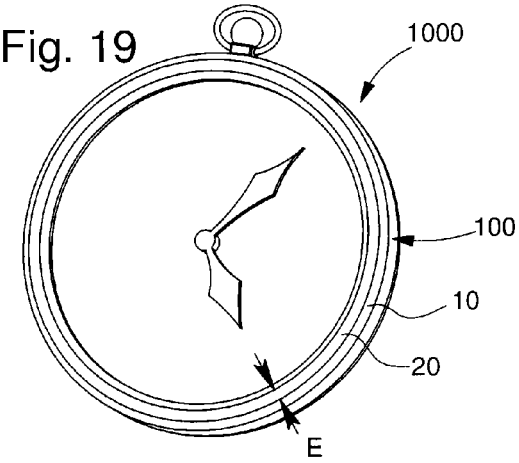
FIG. 19 shows a simplified view of a watch with an external part according to the invention.
Figure 20:
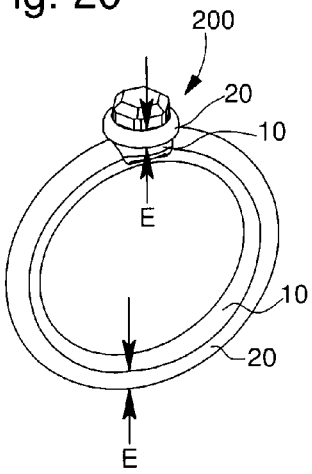
FIG. 20 shows a simplified view of a piece of jewellery made of bimetallic material according to the invention.

- as seen in FIG. 14, a titanium base 10 is cut from a sheet or board, with cutouts 13 and through apertures 12, so as to form a ladder-like structure with lateral support surfaces 14 connected by cross-pieces 18;
- as seen in FIG. 15, these cross-pieces 18 are bent to form stirrups 19, the base then being ready to receive cover plates 20;
- two gold cover plates 20 are brazed onto the lateral support surfaces 14 of base 10, as seen in FIG. 16, the bimetallic blank 30 is thus obtained;
- FIG. 17 shows a section 35 obtained by sawing or cutting along a saw line 32 of blank 30;
- this section 35 is then shaped by deformation to form the external part 100 shown in FIG. 18, in this case a claw of a watch case.

The invention is particularly well suited to making external parts, such as bezels, claws, cases, bracelet links and clasps, although this list is non-limiting. The invention offers the user high quality parts, with a combination of noble metals used with a large thickness brazed onto lighter alloys or metals, guaranteeing resistance to deformation and to mechanical stresses yet still providing a lightness which is much more pleasant to wear.

The invention claimed is:

1. A method of manufacturing a watch case claw, comprising:

- providing a metallic base made of a first material which is titanium and/or a first titanium alloy, the base being cut from a sheet or board, with cutouts and through apertures so as to form a ladder-like structure with lateral support surfaces connected by cross-pieces;
- providing at least two metallic cover plates made of a second material, the second material includes a second metal chosen from among gold, platinum, palladium or silver, and/or a second alloy including at least gold or platinum or palladium or silver each of the cover plates being of a thickness greater than or equal to 0.5 millimeters;
- folding the cross-pieces to form stirrups;
- brazing the two cover plates onto the lateral support surfaces of the base to form a bimetallic blank;
- cutting a section of the bimetallic blank; and
- shaping the bimetal blank by deformation to give the watch case claw a final form thereof.

2. The method according to claim 1, wherein a titanium alloy which is grade 2 titanium, or grade 5 titanium or T35 titanium is chosen as the first material of the base.

3. The method according to claim 1, wherein the brazing is performed with a braze material selected to form a braze between the first material and the second material.

4. The method according to claim 1, wherein the first alloy and the second alloy are chosen to be hypo-allergenic with zero nickel content.

5. The method according to claim 1, wherein an 18 carat gold alloy or platinum alloy with more than 95% platinum is chosen for the second material.

6. The method according to claim 5, wherein a 5N or 3N 18 carat gold alloy is chosen for the second material.

7. The method according to claim 1, wherein the bimetallic blank is formed by drawing deformation.

8. The method according to claim 1, wherein the bimetallic blank is machined to locally remove the cover plates.

9. The method according to claim 1, wherein the base is chosen to have a form of a profile bar.

10. The method according to claim 1, wherein prior to being brazed to one another, the base and the cover plates are prepared with raised and/or hollow markings to match the base and the plates geometrically to each other before the brazing and hold the base and the plates relative to each other during the brazing.

11. The method according to claim 1, wherein each of the cover plates is brazed onto the base over an entire common contact surface thereof.

12. The method according to claim 1, wherein each of the cover plates is brazed onto the base on only one portion of the surface of the cover plate facing the base, and/or on only one portion of the surface of the base facing the cover plate.

* * * * *